US009437059B2

(12) United States Patent
Yeara

(10) Patent No.: US 9,437,059 B2
(45) Date of Patent: Sep. 6, 2016

(54) GATEKEEPER LOCK SYSTEM

(71) Applicant: Christian Yeara, Santo Domingo (DO)

(72) Inventor: Christian Yeara, Santo Domingo (DO)

( * ) Notice: Subject to any disclaimer, the term of this patent is extended or adjusted under 35 U.S.C. 154(b) by 0 days.

(21) Appl. No.: 14/406,222

(22) PCT Filed: Jun. 11, 2013

(86) PCT No.: PCT/IB2013/054793

§ 371 (c)(1),
(2) Date: Dec. 7, 2014

(87) PCT Pub. No.: WO2013/186711

PCT Pub. Date: Dec. 19, 2013

(65) Prior Publication Data

US 2015/0116084 A1 Apr. 30, 2015

Related U.S. Application Data

(60) Provisional application No. 61/659,037, filed on Jun. 13, 2012.

(51) Int. Cl.
*G07C 9/00* (2006.01)

(52) U.S. Cl.
CPC ..... *G07C 9/00031* (2013.01); *G07C 9/00309* (2013.01); *G07C 2009/00761* (2013.01); *G07C 2009/00841* (2013.01)

(58) Field of Classification Search
CPC ..... G07C 9/00031; G07C 9/00309
See application file for complete search history.

(56) References Cited

U.S. PATENT DOCUMENTS

2007/0132550 A1* 6/2007 Avraham ..... E05B 37/08 340/5.21
2009/0085717 A1* 4/2009 Kirkjan ..... G07C 9/00309 340/5.2
2011/0084799 A1* 4/2011 Ficko ..... G07C 9/00904 340/5.65

* cited by examiner

*Primary Examiner* — Leon Flores
(74) *Attorney, Agent, or Firm* — Luis Figarella

(57) ABSTRACT

Disclosed is an electronic lock for a door having a locking mechanism, a file transfer and storage interface and programmable control circuit. This system also provides a communication interface and data transmission. The locking mechanism is coupled to the door and movable between a locked position in which the door opening is inhibited and an unlocked position in which the door is allowed to open. File transfer and storage interface and programmable control circuit is coupled to the gate and is operable to validate user credentials. The programmable control circuit is coupled to the gate and is operable to move the locking mechanism between the locked position and the unlocked position at least partially in response to user credentials read.

4 Claims, 10 Drawing Sheets

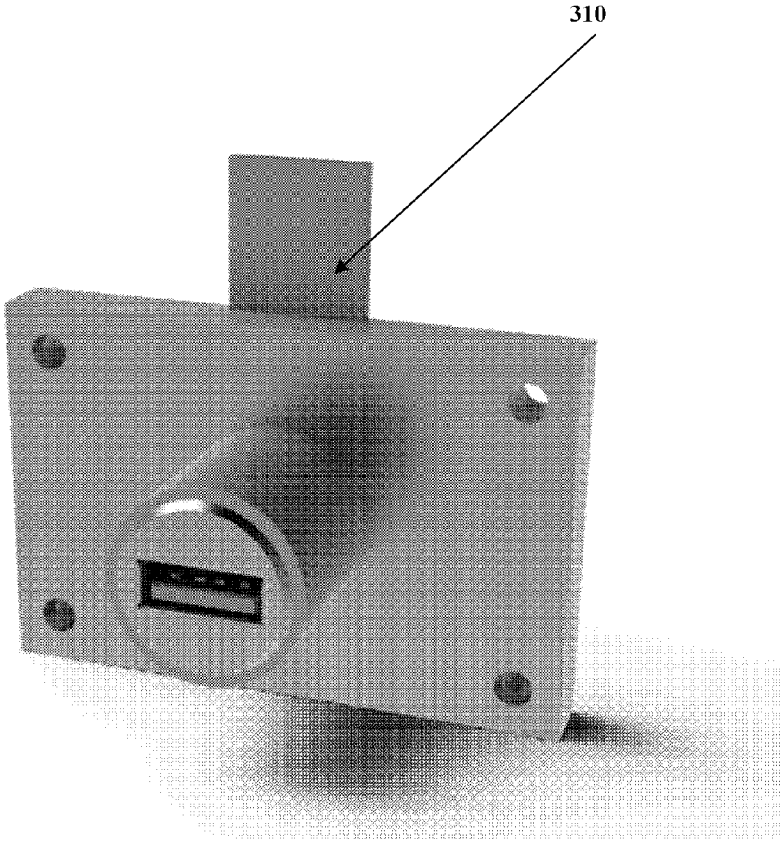
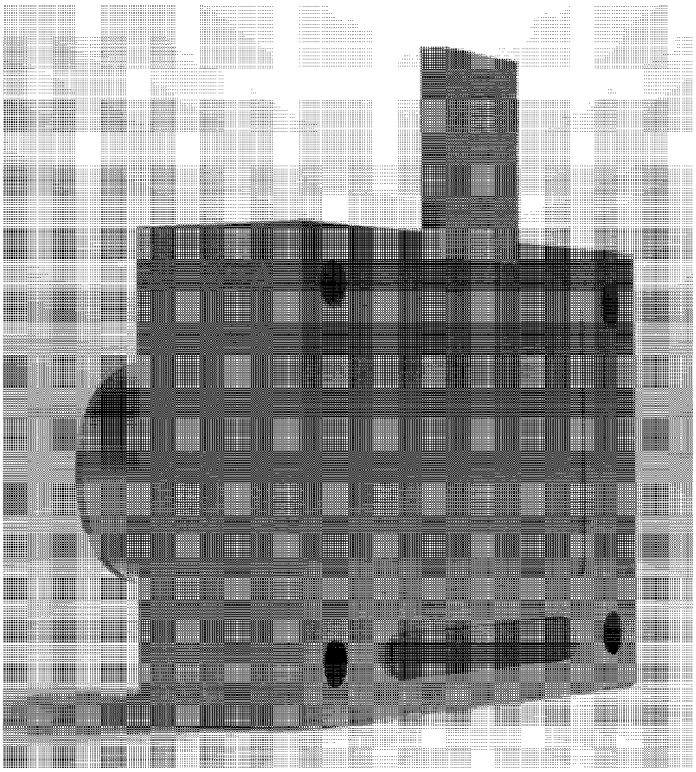
Figure 5A
Figure 5B

GATEKEEPER LOCK SYSTEM

CROSS-REFERENCE TO RELATED APPLICATIONS

This application claims priority to provisional patent application U.S. Ser. No. 61/659,037 entitled "Gatekeeper Lock System" filed on Jun. 13, 2012, as well as to PCT-IB2013-054793 entitled "Sistema de Cerradura Gatekeeper", filed on Jun. 11, 2013, the description of both of the above are incorporated herein by reference in their entirety.

PATENTS CITED

The following documents and references are incorporated by reference into this application in its entirety; Brown et al (U.S. Pat. No. 8,079,240).

FIELD OF THE INVENTION

The present invention relates to an access control systems, and more particularly to an electronic lock for any door, gate or input using an access control system which is activated through an electronic interface.

DESCRIPTION OF THE RELATED ART

Some access control systems require a large number of transient and temporary keys to be supplied to users. Such is the case of tenants, employees, students, etc. Even in simple places, such as houses, where doors are the property of a single entity, a proliferation of keys makes most key chain, keychain or purse, appear to be something of a comedy.

The solution proposed here is to implement a public key infrastructure (PKI or "Public Key Infrastructure") by which electronic files in Tokens or universal FOBs or other electronic interface are programmable and accessible through a "Universal serial Bus" (USB). By creating a digital code that uses USB devices PKI encrypted private keys generated by a PKI public key as a key, users will have more protection than that offered by regular access keys while simultaneously carrying flexibility and access control versatility all users. In addition, the ability to have multiple locks on a single programmable keys and multiple keys for lock; by adding to track and user behavior with that device.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect, the invention is an electronic lock system comprising a lock structure having electronic means for electrical and mechanical connections to a USB FOB, processing and interface electronic means in said lock capable of exchanging electronic files with this USB FOB and validating the PKI information in said files and electromechanical means to allow the opening or closing of a bolt or lock lever.

In another aspect said electromechanical means include one or more electric actuators for opening or closing said lock. In yet another aspect, said electric actuators are comprised of electric motors. In one aspect, said USB FOB includes one or more sources of energy. In another aspect, said electromechanical means include mechanical structures external to said USB FOB to transfer mechanical torque from said USB FOB to said bolt or said lock lever.

Other features and advantages of the present invention will become apparent upon examining the following detailed description of an embodiment thereof, taken in conjunction with the attached drawings.

BRIEF DESCRIPTION OF THE DRAWINGS

FIGS. 5A-5B show two illustrative embodiments of the invention examples, according to illustrative embodiments of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments will now be described, including apparatus and methods for displaying images. However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope hereof.

All references, including any patents or patent applications cited herein are incorporated herein by reference. No admission is made that any reference constitutes prior art. The discussion of the references states what their authors assert, and the applicants the right to dispute the accuracy and relevance of the documents cited are reserved. It is clearly understood that although reference herein number of publications of the prior art is made, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Figure 1:
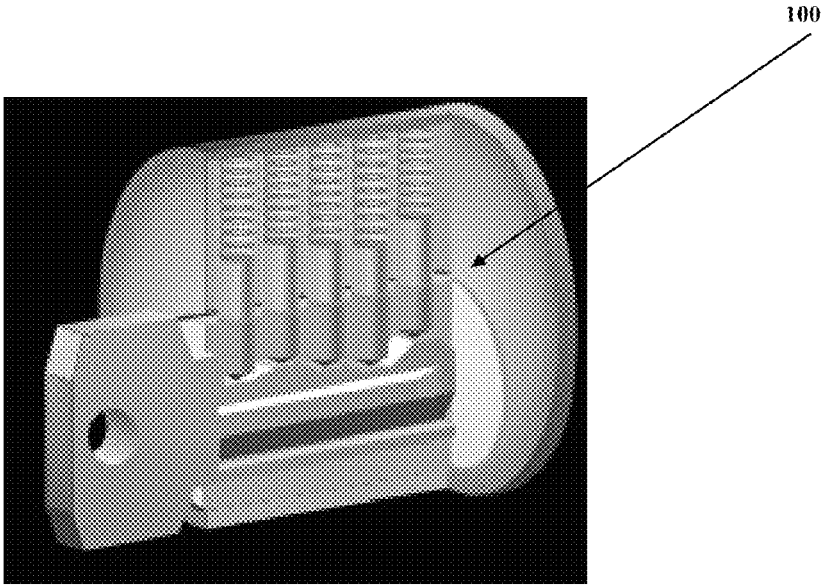
Figure 1 Prior Art
FIG. 1 shows an illustration of a key lock, according to prior art.
Figure 2:
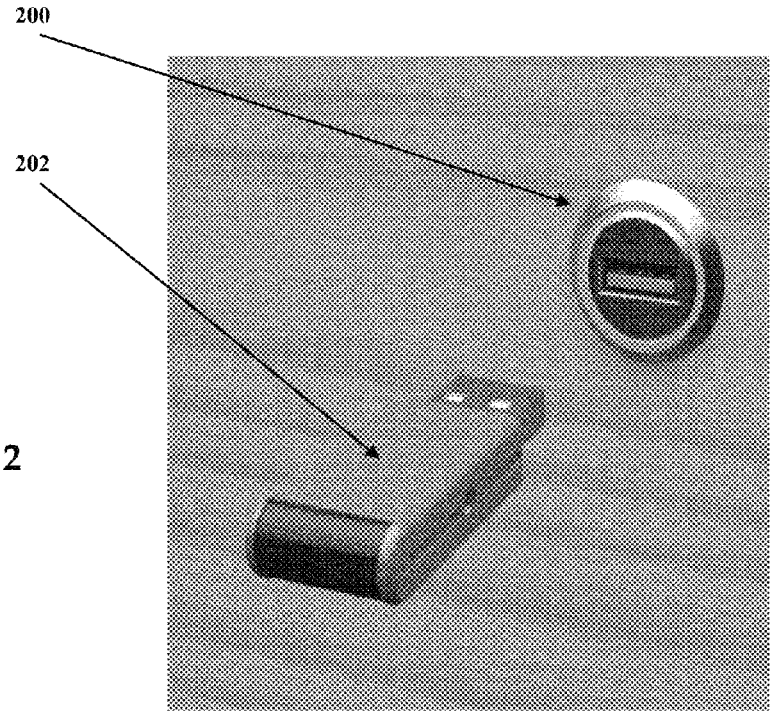
FIG. 2 shows an illustration of a USB lock, according to an illustrative embodiment of the invention.

The present invention is intended to replace the traditional art of lock cylinder 100 shown in FIG. 1. The cylinder locks are ubiquitous, everyone has them in large quantities in our homes and businesses. The idea is to replace the cylinder with an electronic package as shown in FIG. 2, which is able to read the USB Token or FOB 202 through the USB connector into the key cylinder 200, making everything in a completely digital. In one embodiment, the system has the same dimensions as a standard lock cylinder, allowing its adaptation to any mechanical lock/key previously installed. In one embodiment, the system uses the Rijndael algorithm as part of the PKI encryption, although implementation with any other algorithm or cryptosystem method being these standards or not possible. Over time, the 'firmware' system can be reprogrammed to use more advanced encryption schemes.

Figure 3:
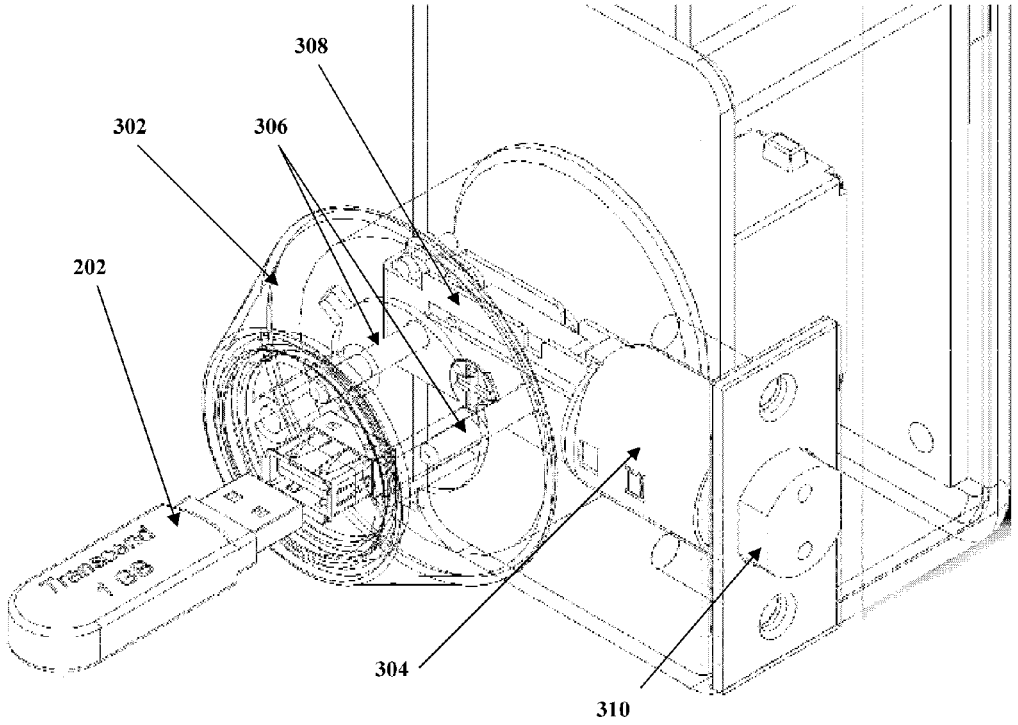
FIG. 3 shows the internal components of a USB lock, according to an illustrative embodiment of the invention.

In one embodiment, the system operates as a standalone system. Each lock has incorporated electronic able to read the files on the FOB USB 202 (or cable connected to a USB device), identify the files contained in them are identifying the right key to its operation, and validate the file (which allowing remove the lock on the door and allow the door to open). In an alternative embodiment FIG. 3 (useful for corporate clients), the locks are either wired or wirelessly connect to a network and, although to a control center, allowing users to monitor the status of the locks remotely, via the Internet or by mobile phone.

In one embodiment, the lock functions as a freely rotating cylinder (or vessel) 302 of assembly, so that if the key is invalid electronics contained within the cylinder simply rotates freely. When is the valid registration, and the electronic processor validates that the files in the FOB 202 are valid, an actuator within the cylinder 304 activates a bolt that achieves the unit is engaged with the rest of the mechanism, so that rotation of FOB 202 in the cylinder 302 through the connection(s) 306 to the lock mechanism 308, and rotation of the user of the lock cylinder 304 proceeds to cause the bolt or other fastening means or "dam" 310 inserting or removing lock in the doorframe. Such openness allows minimal use of energy from the energy source system in the plate. This energy source can be comprised of batteries (lead, Li-Ion, and others) or others like super capacitors or other alternative sources of supply and the system power lines or alternatives such as "Power over Ethernet" or by magnetic induction.

In one option, the rotation of the unit generates the energy used to recharge the unit. In an alternative embodiment, energy to activate the coupling mechanism of the cylinder is obtained from batteries located in the FOB. In an alternative embodiment, the lock is completely automatic, so that once the file is confirmed if approved by the electronics, a motor placed inside proceeds to move the lock bolt or other fastening means or "dam" to inside or outside the frame.

Figure 4A:
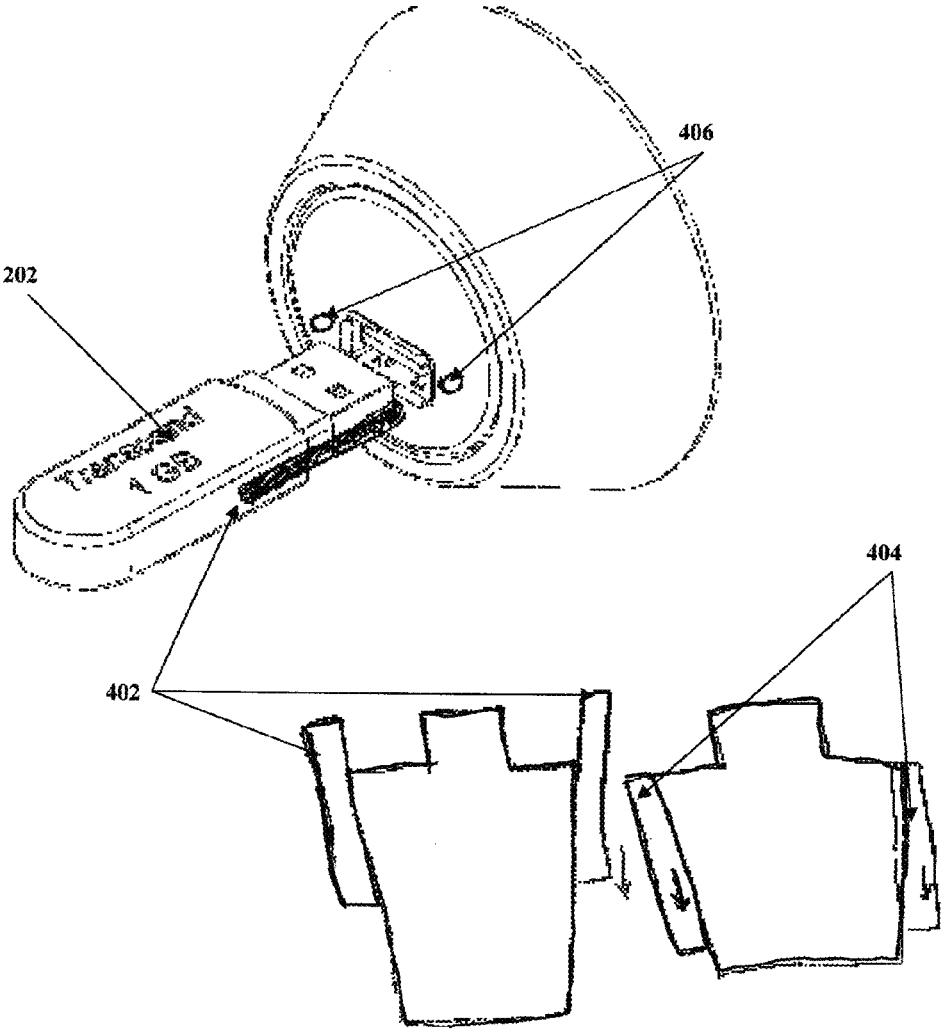
FIGS. 4A-4B show two illustrative embodiments of the invention examples, according to illustrative embodiments of the invention.
Figure 4B:
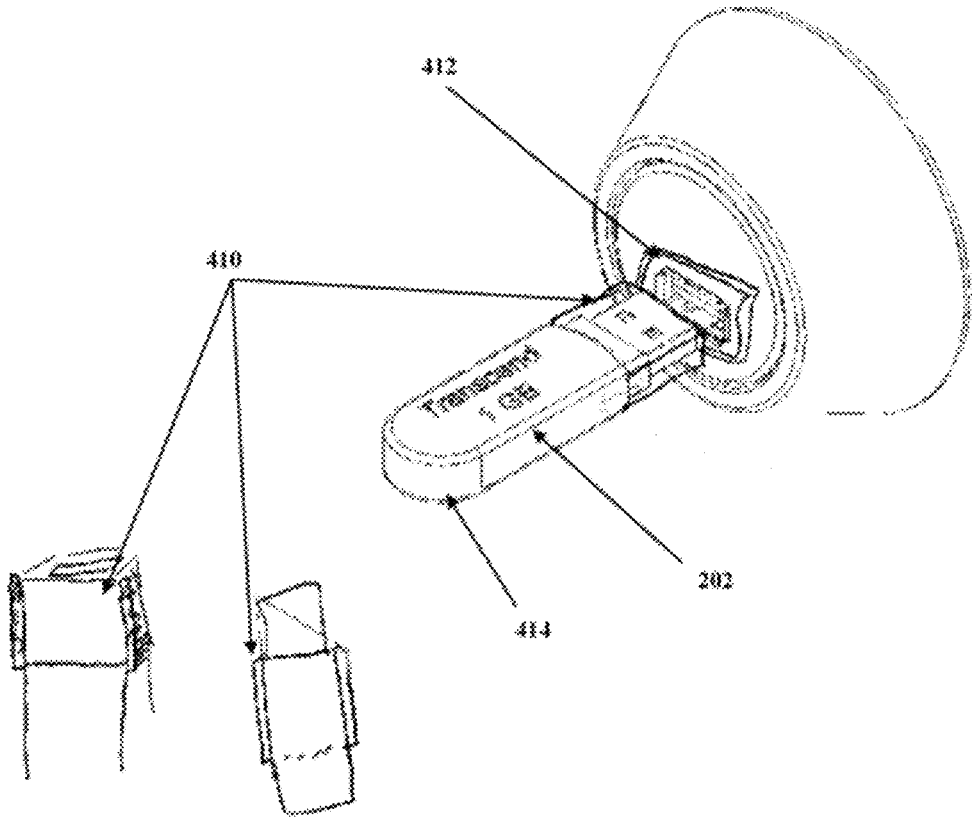

To facilitate rotation of a unit (FIGS. 4A-4B) that requires mechanical assistance by the user, the USB FOB 202 may have external means 402 to mechanically engage with apertures 406 in the cylinder mechanism or locking and providing energy transfer means and the torque movement. Of course, these must be retractable 404 somehow to make it compatible unit with standard USB connection.

In an alternate form, the USB FOB 202 has a sleeve 410 which extends or retracts, and into a space around the USB 412 connector, allowing transfer of power and movement to the torque as required by the insertion/removing the bolt 310. As shown earlier, the USB FOB 202 could have a battery 414 inside its box or accommodation, which provides energy to the system operation.

Figure 6:
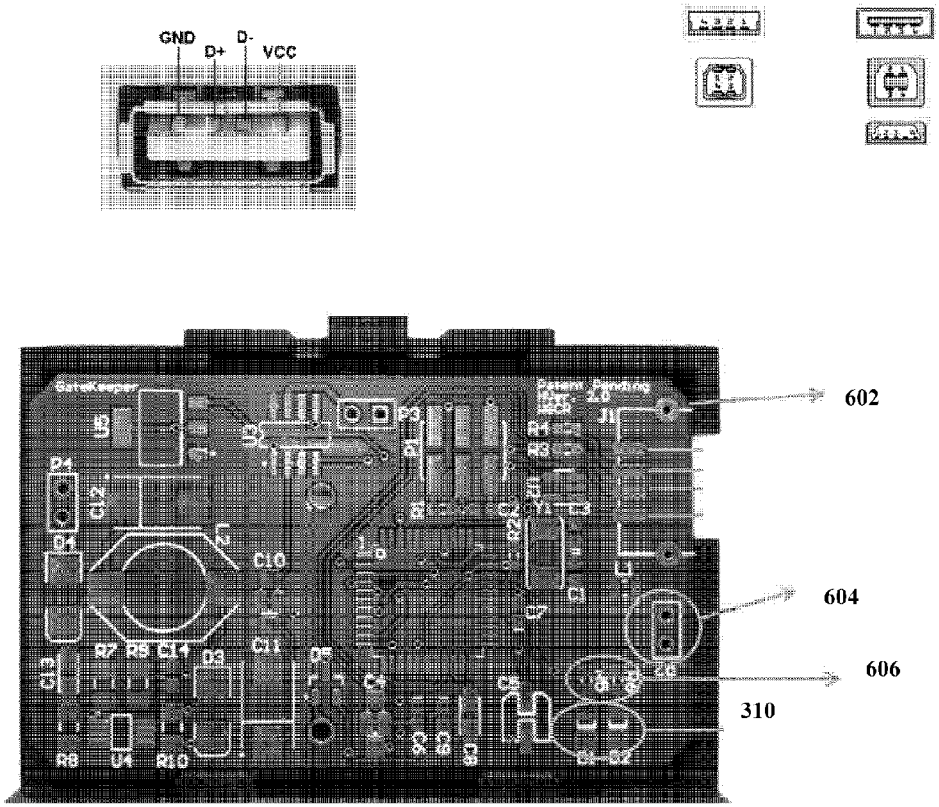
FIG. 6 shows an example of the electronic components of the system, according to an illustrative embodiment of the invention.

As exhibited in FIGS. 5A-5B, the bolt 310 may have the form of a rectangular tab or extension. The tab can be activated, like the bolt rotatably through mechanical rotation by the user in the USB device, or through FIG. 7 of the mechanical action of a lever/rotator 702 separately after the USB device is inserted into the slot and PKI key is valid. By an electric motor or other actuator too, could be activated. One embodiment in FIG. 6, the central processor system is implemented on a PCB ("Printed Circuit Board" or PCB) which has a number of interfaces. This includes, as we look in FIG. 6 includes the pair stand mount receptacle 602, output for connection to an external LED 604, electrical resistance 606. In some cases could include a keyboard to allow the user the use of keys or numeric keys.

Through the electronic programming, the invention allows a single physical key, in one embodiment a USB FOB 202 enough to store the file of one or more locks memory. Thus, a unique "key" you can open all the locks in a house, building or home. The ability to have a file containing the encryption key to open a door (physically equivalent to a key), allows dynamic allocation of these keys. When a key is lost physically, it can provide a replacement file and replace or override the file available in the lock or door. In other implementations could use a processor in the system to allow the FOB to the opening required, unlike the use of a memory directly on the validation device.

Some users may have the ability to create or copy new keys. In addition, users can be separated into groups so that some are allowed entry or exit at certain times, for a limited time. Multiple locks can be programmed into a single device. The system is compatible with most existing and mechanical/electronic locks.

Figure 7:
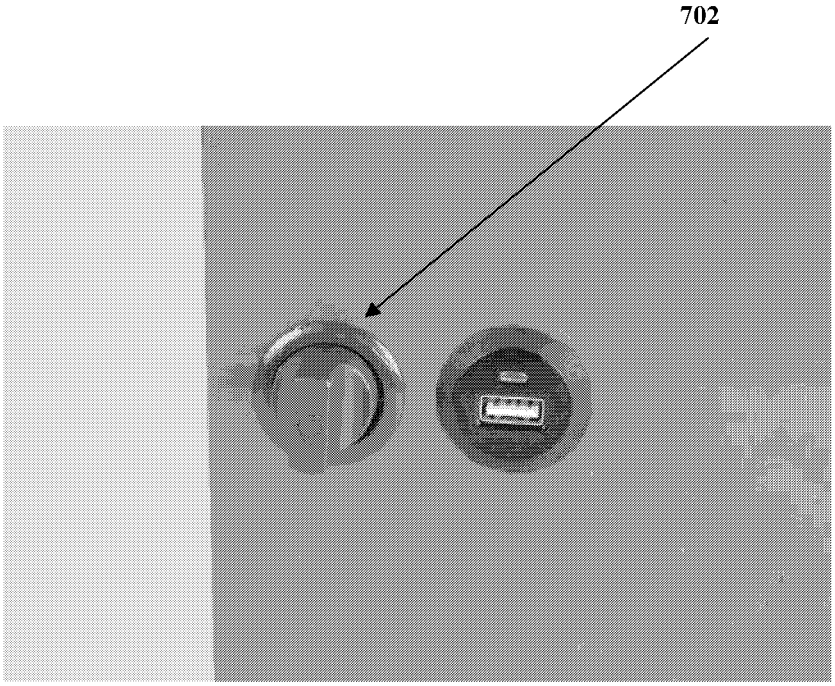
FIG. 7 shows an example of another exemplary configuration where the latch opening is achieved through the mechanical action of a lever, according to an illustrative embodiment of the invention.
Figure 8:
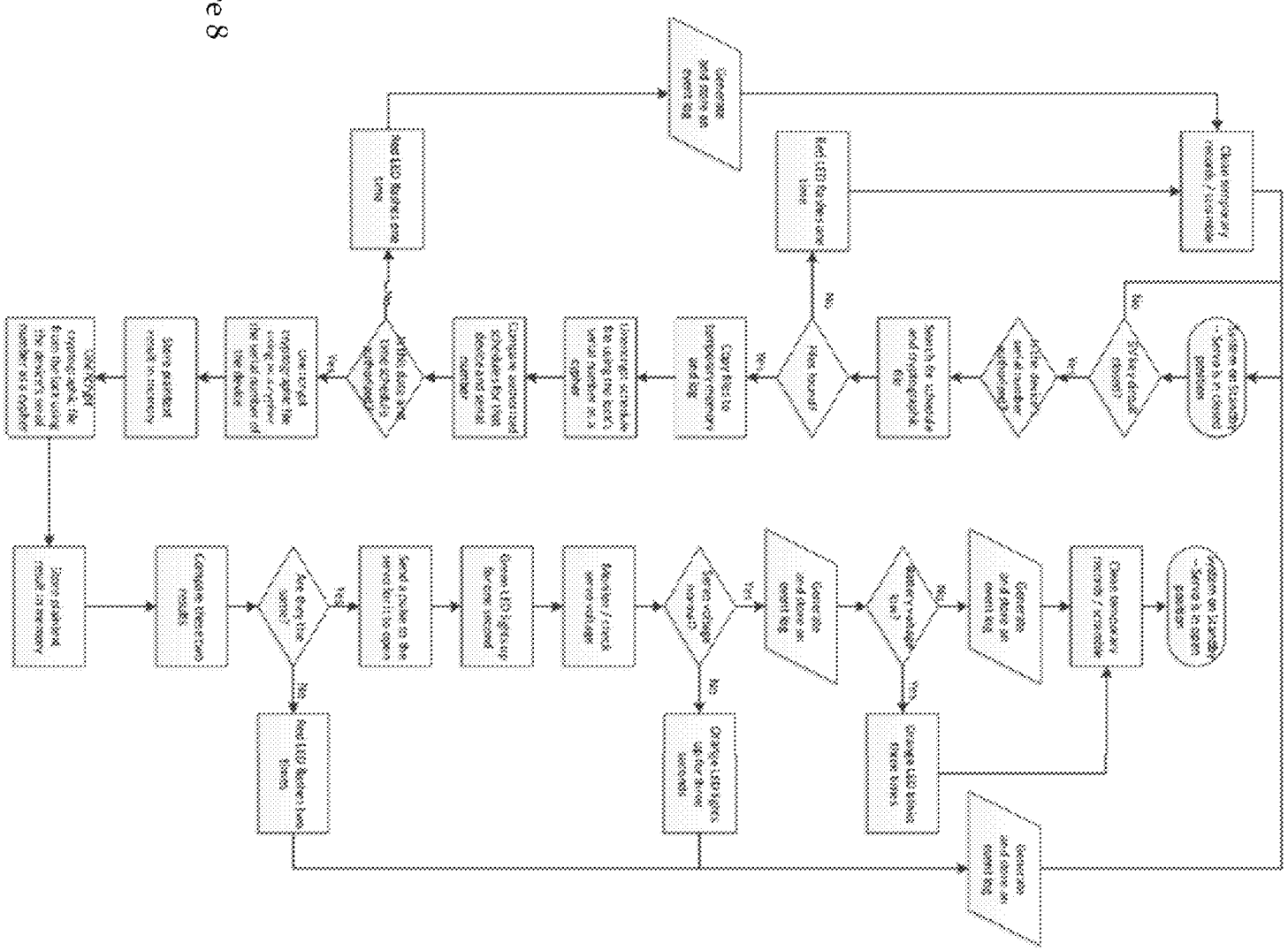
FIGS. 8-10 show examples of the flow charts covering the opening process, creating new records and download key for a key, according to an illustrative embodiment of the invention.
Figure 9:
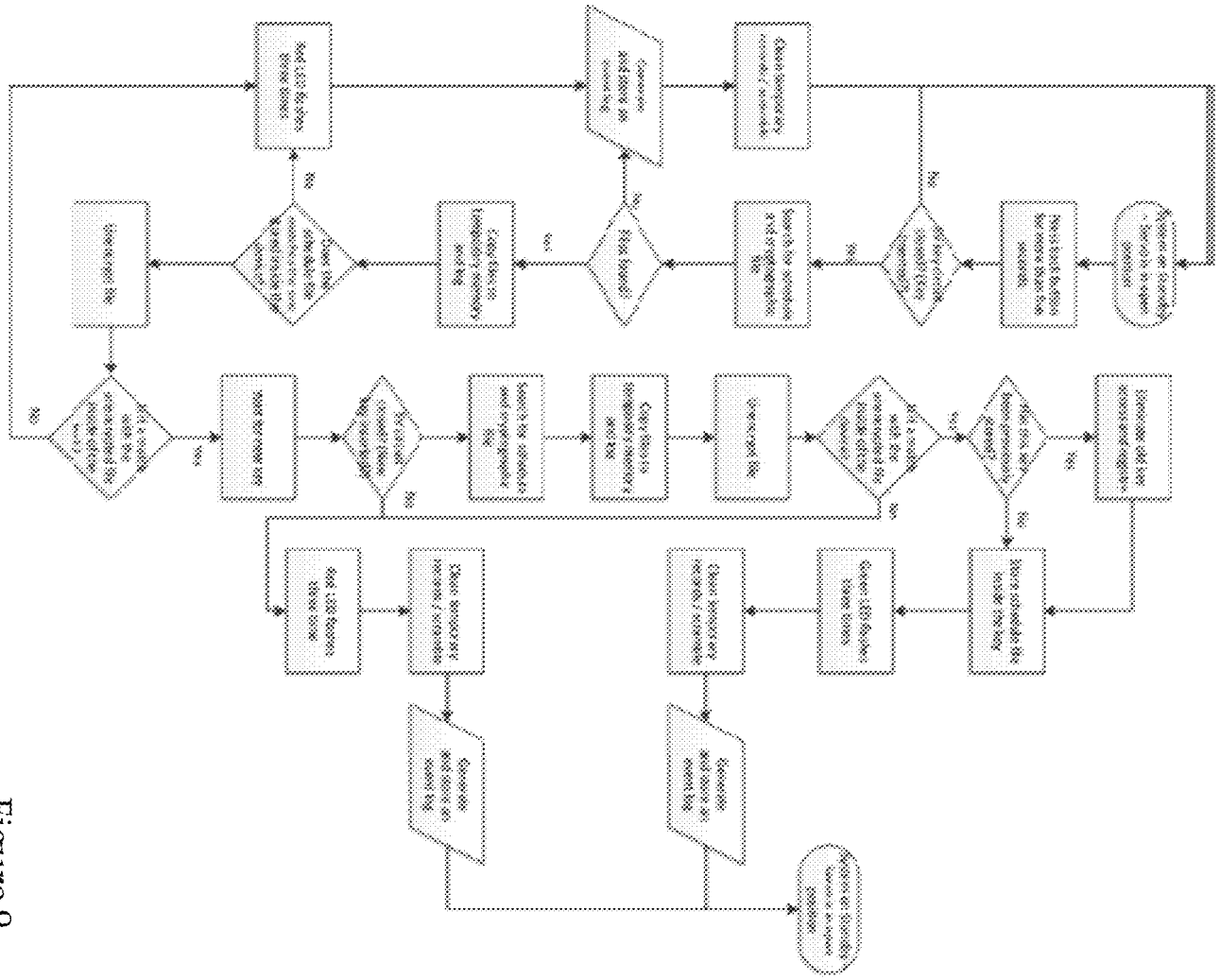
Figure 10:
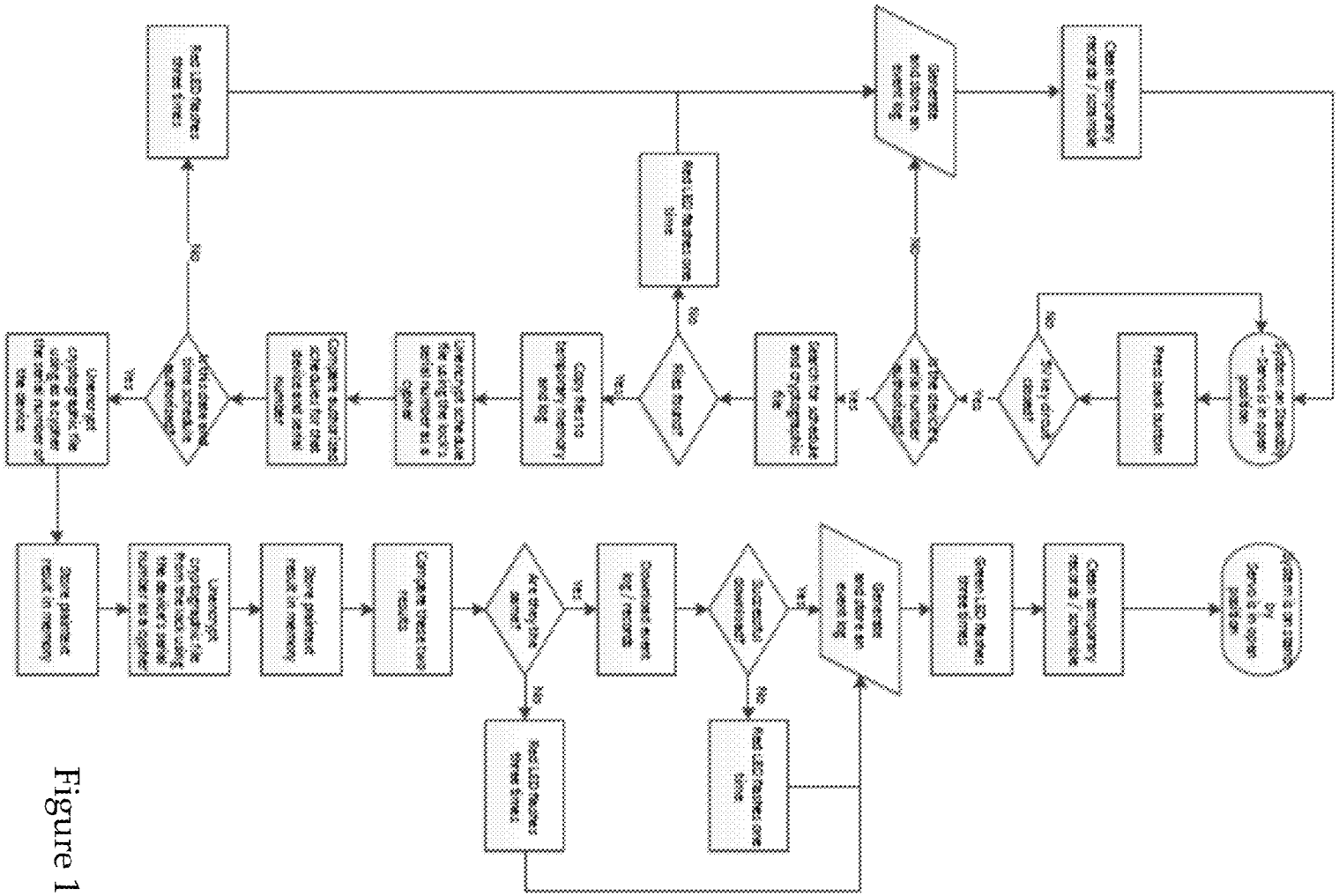

FIGS. 7-9 show flowcharts showing examples of the opening, creating new key and download records for a key. In one embodiment, the system uses a proprietary protocol, for the purposes of preparation of new Tokens USB devices, such as for authentication against the System. The protocol is based on the scheme of Requests and Responses, similar to FTP or HTTP protocols.

The following terms are part of the commands found in the UTAP protocol: HELLO: This command allows a device to initiate a request against Digital Security System. GET-BIO-C: This command is sent as an application, Security System, against the device or USB Token currently connected. The system requests the device, this sends the BIO-CIPHER to be validated against BIO-CIPHER in the database of the system. Of course, the micro processor in the system is able to know the UTAP protocol or other communication protocol that is right.

In an alternate embodiment, the system performs only readings on the USB device, searching files with specific names in the USB Token (in this case, it would be only a memory) and then do validation level Security System. The BIO-C stored in the Token serial files are named using randomly created, which identify each person as unique carrier Token permissions in the system; These files are stored in the database of BIO-Cs in the system. AUTH-OK: This is a response message indicating that the device or USB Token has been successfully authenticated. AUTH-FAIL: This is a response message indicating that the device or USB Token authentication failed against Security System; if you make 3 failed attempts, the system crashes. FAILED-BLOCK: This is the message that the system has been blocked; This can only be unlocked with a key PUK-KEY.

HELLO-UNBLOCK: This command allows a device to initiate a request against Digital Security System for unlocking. SEND-PUK: This command is sent to the device or USB Token, indicating that the system is waiting for the unlock PIN. SETUP: This command is sent to the System Security, for this initialize the device or USB Token, to carry a Public key and encrypted data owner, or BIO-CIPHER. In an alternate embodiment, the locking device acts as a host or "Host", which allows you to read the contents of files into memory and serial memory itself.

SEND-CHALLENGE: The system prompts the device or USB Token, this sends the challenge or question to be validated by the system; USB Token sends this message, accompanied by the challenge or response to the question des-encrypted with your public key. CHALLENGE-OK: The system returns a response message that the challenge has been successfully validated. SET-BIO-C: The USB Token sends the command to the system, so that it sends the Bio-C to be saved in the USB Token. BIO-OK: The Token sends this message to indicate to the system that has been successfully saved BIO-C in your memory.

In one embodiment, the digital security scheme is based on the use of the RSA algorithm, which is an asymmetric algorithm that uses two keys: An Post and the other private. The private key is stored in the Digital Security System. Each key or USB Token contains a Public Key, which is associated with a private key stored in the Digital Security System. It can only be a couple of public and private keys, relate to each other. In an alternate embodiment, Digital Certificates are issued, and will be saved in the USB Token; the system would have to recover the public key contained in the certificate.

The Security System; up n private keys stored for each n Tokens delivered to the customer; These keys are configured on the system, customer demand has acquired the system. The aim of the initialization process, is the ability to save a BIO-C file into the USB Token; This file will then be necessary during this Token authentication against the system. If a microprocessor in the Token, should also be a firmware that runs on the CPU, and that implement the UTAP protocol or other communication protocol that is right.

To initialize the Token always sends a SETUP command and when not initialized. A Token is not initialized when this does not contain a file BIO-C; the name of this file is a randomly generated serial. The public key token holder or a Digital Certificate, counterpart of a private key stored in the system. If this has no public key contained within the system related private key, it can not meet the challenge ("challenge") that the system started.

The system responds to the SETUP with a CHALLENGE message, which represents a challenge or challenge to the device; This message is accompanied by the challenge, which consists of a cryptogram, the Token must be able to decrypt using your public key; If this fails to decrypt the message, the system will not allow this Token is initialized successfully. In one embodiment, the challenge is a random value generated by the system, of which the SHA1 hash type, to finally be encrypted with RSA, using the private key stored in the system is obtained; only can get back this value (hash) if RSA is applied using the related public key, which must be in the USB Token currently connected.

The Token proceeds to decrypt the value, and answers a SEND-CHALLENGE, accompanied by hash value, which the system proceeds to validate. The system validates the challenge response, and then compares this value received, with the value in memory created for this challenge; if the value is correct, the system responds CHALLENGE-OK, accompanied by BIO-C file, which was named with a random serial. The Token proceeds to save this file BIO-C, and responds with a message BIO-OK. In one embodiment, the challenge message, can be a digital signature which can be verified by the USB Token; anyway, the decrypted message should be sent back to the system in response.

During the initialization process, the system stores a hash of the file contents, which will be compared to the hash of BIO-C sent by the Token by the authentication process. In the case that the USB Token does not have a microprocessor, that is, if it is only a USB stick, this will only contain a public key, which will allow the system to read, and then validate the challenge in same system, using this key. In the latter case, during the initialization process, the system must read the serial memory, and store this value, along with other personal data carrier Token in a BIO-C file with serial randomly generated name. The system encrypts the BIO-C, and stores the encrypted file in the Token memory.

If the system supports PIN authentication, then the system will prompt the user to enter and confirm a PIN protection for this Token; This PIN will be protected in the BIO-C file, which must be encrypted before sending the Token USB device. If a microprocessor in the Token, should also be a firmware that runs on the CPU, and those implements the UTAP protocol or other communication protocol that is right.

To authenticate the token, the token must be connected, so that the authentication process is performed. The Token sends a HELLO to the system. The system response requesting the BIO-C, using the GET-BIO-C command. The Token prepares the response and transmits it as a BIO-C. The system verifies that the hash of the contents of BIO-C received file exists in the database of persons authorized by the system; If the Token supports PIN authentication, then the system will prompt the user to enter the PIN at the time: If the user enters three times configured on an invalid PIN, the system will block the Token; if the pin is correct in this case, the system proceeds to open the lock, and sends a message AUTH-OK, indicating that it was successfully authenticated.

If the token does not support PIN to access, and Token has intelligence, can only encrypt the hash of the file, and send this hash in response to GET-BIO-C; the system, in this case, measures the size of the response, and if you have 20 bytes (sha1), then proceeds to find this value in the database; then releases the lock.

If the system fails authentication, then issues a response to a message AUTH-FAIL, indicating that authentication has failed. If the user tries three times or n times configured in the system, using this Token, and this still receive the message AUTH-FAIL, the system sends a message FAILED-BLOCKED, to indicate that this token is locked and can not be used for authentication. A locked Token can be unlocked using a master key system that is in possession of the system owner; or by issuing a communication in some way to be received and processed by the device.

EXAMPLE 1

The system owner has a Master Security Token, which should be protected by a PIN. The user uses this token, when you need to unlock a locked Token PIN. To unlock, the user enters the Master Token, which sends a message HELLO-B. The system responds with a message SEND-PUK. The Token must send the PUK, for the system to prepare the system to unlock a Token; the system validates the PUK, and responds PUK-OK-READY.

The user then enters this time, the locked device; the system prompts the user to put a new PIN: Enter PIN; the user must enter the PIN at the time, Re-Enter PIN; the user to re-enter the PIN for this to be verified, if the PIN correctly twice was introduced, the system prompts: PIN Ok. The token is unlocked; if fault entering the PIN, the system prompts: Invalid PIN and Confirmation; the user must re-enter the PIN twice until the system says P.

EXAMPLE 2

The user can enter the Token locked, and then press a button Unblock system; the system prompts the user to enter the PIN PUK. The user must know the PIN master of unlocking, or have it written down somewhere safe; prompted for the PUK; Enter PUK: If the PUK is correct, then the system prompts the user to put a new PIN; Enter PIN; the user must enter the PIN at the time or Re-Enter PIN; the user to re-enter the PIN for this to be verified; If the PUK is invalid, the system crashes in 10 attempts. It can only be unlocked using a Token Master Locks Company.

If the PIN is entered correctly twice, the system prompts: PIN Ok. The token is unlocked; if fault entering the PIN, the system prompts: Invalid PIN and Confirmation; the user must re-enter the PIN twice until the system says Ok PIN.

By packaging the system within the current size of the system is installed in existing locks without changing decorative plates, keys are available for all users who may have an FOB USB, or other transfer system electronic file. In one embodiment, the system consists of three components, an online platform, an application for mobile phones and computer application.

The online platform gives business users the ability to empower control over your locks. With the mobile phone application is possible remote monitoring and control devices. This allows the system to submit periodic reports on the status of devices, deny or allow remote access and remotely replace keys, which have been lost or stolen. Furthermore, it is possible to know the status of devices in real time, those entering through the gates or locks used, alert the user to misuse, access after hours and anomalies, anything is possible by sending an SMS, email mail, phone or any other method of communication or transmission of information available to the user.

In one embodiment, it would allow the user to create, via the Internet, access times and schedules so he can remotely control your key or lock through Internet and/or phone or other handheld device.

The system may also allow a user with basic knowledge of computers, create copies and delete the key itself without other tools besides a computer, tablet or USB ports. The system allows the use of lists of schedule that allows the creation of different input patterns based on certain times of day or days of the week. Thus the system would have access schedules which are useful for allowing access only to hours, days and specific months. It is equally possible to change these times and modify these accesses remotely.

In one embodiment, keys or tokens port/USB format would be created with the addition of a transmitter of data, which might make them RFID, Bluetooth, NFC or other allowing the keys to be programmed by a user with your mobile phone another portable device or even the same device/lock. This would allow users programs your keys without the aid or assistance of any other device with a USB socket.

In an alternative embodiment, system security can be increased to have characteristics of biometric access. These would be used to open the locks, either as part of the lock assembly, or as part of the FOB.

Similarly, the system can be equipped with key systems, or "keyboards" where the codes to be entered is generated and displayed on a screen in the housing FOB, lock or key. Thus, the human being enters the number of a notebook at once (either six fifty-six digits or more). In an alternative embodiment, the FOB has an added RFID tag, which is active in the system once the FOB is introduced.

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. An electronic lock system comprising: a lock structure having electrical and mechanical connections to a Universal Serial Bus USB FOB; processing and interface electronic components in said lock structure capable of exchanging electronic files with this USB FOB and validating a Public Key Infrastructure PKI information in said electronic files; mechanical components that include a free rotating cylinder; and an electromechanical actuator that engages a bolt, so that upon activation by said interface electronic components said free rotating cylinder engages with the lock structure, allowing the rotation of said USB FOB to rotate or translate the free rotating cylinder and perform the opening or closing of a the bolt or lock structure lever; wherein said mechanical components include mechanical component structures external to said USB FOB, and complementary openings within said lock structure in which to insert said mechanical component structures, in order to transfer mechanical torque from said USB FOB to said bolt or said lock structure lever.

2. The system of claim 1, wherein said USB FOB includes one or more sources of energy.

3. The system of claim 1 wherein;

said mechanical component structures are comprised of prongs.

4. The system of claim 1 wherein;

said mechanical component structures are comprised of a sleeve around said USB FOB.

* * * * *